US007090140B2

(12) United States Patent
Feldmeth et al.

(10) Patent No.: US 7,090,140 B2
(45) Date of Patent: Aug. 15, 2006

(54) METHOD AND DEVICE FOR MONITORING BURNERS

(75) Inventors: Rainer Feldmeth, Rheinstetten (DE); Volker Klumpp, Weisenbach (DE); Dieter Pfannstiel, Frankenberg (DE)

(73) Assignee: Siemens Building Technologies AG, Zürich (CH)

( * ) Notice: Subject to any disclaimer, the term of this patent is extended or adjusted under 35 U.S.C. 154(b) by 79 days.

(21) Appl. No.: 10/473,329

(22) PCT Filed: Mar. 14, 2002

(86) PCT No.: PCT/IB02/00788

§ 371 (c)(1),
(2), (4) Date: Feb. 12, 2004

(87) PCT Pub. No.: WO02/077529

PCT Pub. Date: Oct. 3, 2002

(65) Prior Publication Data

US 2004/0112970 A1 Jun. 17, 2004

(30) Foreign Application Priority Data

Mar. 26, 2001 (DE) ..... 101 14 823

(51) Int. Cl.
*F23N 1/08* (2006.01)

(52) U.S. Cl. ..... 236/21 B; 236/20 R

(58) Field of Classification Search ..... 236/21 B, 236/21 R, 20 R, 46 R, 94, 91 F; 62/158; 237/8 R, 8 A
See application file for complete search history.

(56) References Cited

U.S. PATENT DOCUMENTS 4,470,541 A 9/1984 Raleigh
4,951,870 A * 8/1990 Ballard et al. ..... 236/11
6,059,195 A * 5/2000 Adams et al. ..... 236/20 R
6,129,284 A * 10/2000 Adams et al. ..... 236/21 R

FOREIGN PATENT DOCUMENTS

| | | |
|---|---|---|
| DE | 19542088 | 4/1973 |
| DE | 3923773 | 3/1990 |
| EP | 0825385 | 2/1998 |
| JP | 06-288538 | 10/1994 |

* cited by examiner

*Primary Examiner*—Chen Wen Jiang
(74) *Attorney, Agent, or Firm*—Maginot Moore & Beck

(57) ABSTRACT

The invention relates to a device and a method for monitoring burners using an automatic heating machine (1) for controlling or regulating the burner (15), and a temperature controller (5). At least the flow/boiler temperature (T?VL?) is detected and is compared with a predeterminable first maximum flow boiler temperature (T?VLmax1?) by means of the temperature controller (5). The burner (15) is switched off when the flow/boiler temperature (T?VL?) reaches or exceeds the predeterminable first maximum flow/boiler temperature (T?VLmax1?), while the flow/boiler temperature (T?VL?) is compared with a predeterminable second maximum flow/boiler temperature (T?VLmax2?) which is higher than the predeterminable first maximum flow/boiler temperature (T?VLmax1?). The burner (15) is switched off and locked when the flow/boiler temperature (T?VL?) reaches or exceeds the predeterminable second maximum flow/boiler temperature (T?VLmax2?) and additionally when an error signal (F) is produced by the temperature controller (5). The error signal (F) is produced when the burner (15) has not been switched off correctly by the temperature controller (5) when the first maximum flow/boiler temperature (T?VLmax1?) has been achieved.

17 Claims, 1 Drawing Sheet

METHOD AND DEVICE FOR MONITORING BURNERS

Figure 1:
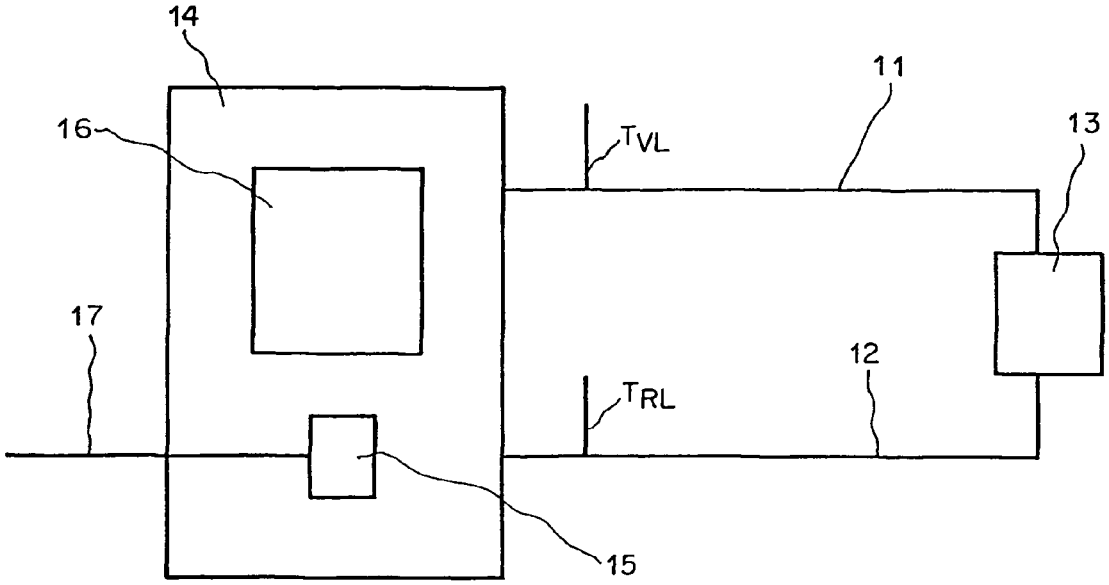

The present invention relates to a method and a device for monitoring burners according to the precharacterizing clause of the independent claims 1 and 7 and also a test method for testing the method and/or the device according to claim 15.

Methods and devices for monitoring burners with automatic burner controls for controlling or regulating the burner are already known, which are used in heating systems of all types, for example in oil- and gas-fired systems for heating buildings. These methods and devices usually use regulators for regulating the automatic burner controls and temperature monitors for monitoring maximum temperatures in the heating system, such as for example the boiler or the flow temperature, in order to detect unsafe operating states, such as for example the overheating of the boiler.

For monitoring thermal sources or boilers in terms of safety, there is already sensor technology, such as for example boiler sensors, flow sensors or return sensors, which detects the temperature of the heating water in the boiler in the flow pipe or in the return pipe. Moreover, known methods and devices for monitoring burners have further, mostly mechanical, limiting devices which detect a maximum temperature and, if it is exceeded, switch off the burner and lock it. In this case, either the heating engineer or the operator of the heating system must ascertain why this operating state was reached, i.e. detect the error, in order to release the locking and enable the burner to be switched on again.

It is furthermore known with regulating devices, in particular for cost reasons, to replace mechanical components with electronic components and to equip the electronic components with multiple functions and corresponding algorithms.

The known state of the art has the disadvantage that the previously known devices and methods for monitoring burners have safety devices which switch off and lock the burner in the case of unsafe operating states, such as for example the reaching or exceeding of a maximum temperature, without distinctions being able to be made between different cases. For example, there are operating states which are similar or correspond to such an unsafe operating state without safety being an issue. For example, so-called reheatings occur after a burner has been switched off in the case of thermal sources and/or boilers which contain a small amount of water and which in this case, if the maximum temperature is exceeded, would not necessarily need to be locked. Furthermore, with the known devices and methods, the dynamic behaviour of the boiler and/or the thermal source cannot be monitored in connection with the already existing sensors for measuring different temperatures or operating states. Neither is a preventative monitoring of the burner possible, as only predefined and fixed operating states are monitored, not however the behaviour of the burner before or after these operating states.

The object of the invention is therefore to improve the known methods and devices for monitoring burners such that a dynamic monitoring of burners is made possible which detects the operating states before or after an unsafe operating state is reached. It is also the object of the present invention to provide a test method for testing such a method or such a device.

The invention achieves the object on which it is based by means of the characterizing features of the independent claims 1 and 7 and also by means of claim 15.

Advantageous variants and designs of the invention are characterized and described in the dependent claims.

The method according to the invention for monitoring burners has an automatic burner control for controlling and/or regulating the burner and optionally a regulator for regulating the automatic burner control and also a temperature monitor, at least the flow/boiler temperature being detected and compared by means of the temperature monitor with a predefinable first maximum flow/boiler temperature and the burner being switched off if the flow/boiler temperature reaches or exceeds the predefinable first maximum flow/boiler temperature.

For monitoring the burner according to the invention, the temperature monitor is tested and/or monitored as follows: The flow/boiler temperature is compared with a predefinable second maximum flow/boiler temperature, the predefinable second maximum flow/boiler temperature being higher than the predefinable first maximum flow/boiler temperature, and the burner is then switched off and locked if the flow/boiler temperature reaches or exceeds the predefinable second maximum flow/boiler temperature and also an error signal of the temperature monitor was produced.

There is thus no locking of the burner if the flow/boiler temperature reaches the predefinable second maximum flow/boiler temperature, i.e. a presettable safety temperature, rather there must be an additional error signal which depends as follows on the specific operating states of the burner. It is to be taken into account that both the flow and the boiler temperature can be used to monitor the unsafe operating state "Overheating of the boiler and/or the thermal source". The method according to the invention thus uses the already-existing sensor technology with the known heating systems and thus replaces the previously customary mechanical safety temperature limiters which mostly monitored the temperature in the flow or in the boiler with a special sensor.

The error signal of the temperature monitor is produced if the flow/boiler temperature reaches or exceeds the predefinable first maximum flow/boiler temperature and a status signal of the temperature monitor signals no switching-off of the burner or there is no status signal of the temperature monitor. In this case the temperature monitor has failed, i.e. the burner was not switched off although the first maximum flow/boiler temperature was reached or exceeded.

The error signal of the temperature monitor is also produced if the flow/boiler temperature reaches or exceeds the predefinable first maximum flow/boiler temperature and a burner valve signal signals an open burner valve or there is no burner valve signal. In this case, the first maximum flow/boiler temperature has been exceeded without the fuel supply to the burner being interrupted. In this case also, the error signal is produced which leads to the switching-off and locking of the burner.

According to the present invention, the burner is therefore not locked if, although the second maximum flow/boiler temperature is exceeded, the temperature monitor "reports" a normal switching-off of the burner. This normal switching-off of the burner occurs if the first maximum flow/boiler temperature was reached or exceeded and the temperature monitor reports a status signal which confirms the sending of an "OFF" signal to the automatic burner control and if a burner valve signal signals the closure or the closed state of the fuel valve.

Such a reaching of the second maximum flow/boiler temperature with switched-off burner is called reheating. This reheating is initially not a critical operating state as it is not caused by any error in regulation but by unfavourable operating conditions or operating states. In order to establish whether this reheating occurs repeatedly during the day in the burner, according to an advantageous variant of the present invention, a special counter for the reheating has its reading raised if the second maximum flow/boiler temperature is reached by a reheating. In this case, the error signal of the temperature monitor is produced if the flow/boiler temperature reaches or exceeds the predefinable second maximum flow/boiler temperature more than a predefinable number of times without a locking of the burner having taken place. If the reheating thus occurs for example more than ten times a day, an error does seem to exist (for example the pump is not running correctly) and consequently, if this counter limit is exceeded, the automatic burner control and/or the burner must be locked and a corresponding error code displayed.

Similarly the error signal of the temperature monitor is however not produced if the flow/boiler temperature does not reach or exceed the predefinable second maximum flow/boiler temperature the predefined number of times within a predefinable period of time, without a locking of the burner having taken place. If therefore this maximum limit of the counter (for example ten times a day) is not exceeded, the counter is reset to zero every 24 hours. Advantageously this maximum number can be predefined, i.e. set on the device according to the invention.

Naturally the burner is then switched off and locked in any case according to an advantageous variant of the present invention if the flow/boiler temperature reaches or exceeds the predefinable second maximum flow/boiler temperature and the error signal of the temperature monitor was blocked or is not present. In this case the device according to the invention operates like a mechanical temperature limiter.

The device according to the invention has or advantageously uses a temperature sensor to detect the flow temperature or the boiler temperature of a heating system, whilst the temperature monitor compares this measured temperature with the predefinable first maximum flow/boiler temperature and switches the burner off if this is reached or exceeded.

According to the present invention, a temperature limiter, in particular an electronic safety temperature limiter, compares the flow/boiler temperature with the predefinable second maximum flow/boiler temperature, which is higher than the predefinable first maximum flow/boiler temperature, and sends a switch-off signal to switch off and lock the burner on the automatic burner control if the flow/boiler temperature reaches or exceeds the predefinable second maximum flow/boiler temperature and the temperature limiter also receives an error signal.

As already described above, the temperature limiter receives an error signal if the flow/boiler temperature reaches or exceeds the predefinable first maximum flow/boiler temperature and the temperature monitor sends a status signal to the temperature limiter which signals no switching-off of the burner and/or the temperature limiter detects an open burner valve by means of a burner valve signal. The temperature limiter itself generates an error signal if it receives no burner valve signal or no status signal of the temperature monitor and/or if the temperature limiter has none of these signals, because the temperature limiter must then assume that either the signal transmission path or the signal transmitter itself is defective. In this case also, the temperature limiter then has the function of the mechanical safety temperature limiter which, if the second maximum flow/boiler temperature is exceeded, switches off and locks the burner.

Advantageously the temperature limiter has a counter which counts the number of times the predefinable second maximum flow/boiler temperature is reached or exceeded without a locking of the burner having taken place. The temperature limiter receives or generates no error signal if the counter does not reach or exceed a predefinable number within a predefinable period of time.

An advantageous version of the method according to the invention and/or the device according to the invention is explained in more detail using the drawings. There are shown in:

FIG. 1: the schematic representation of a heating system, and

Figure 2:
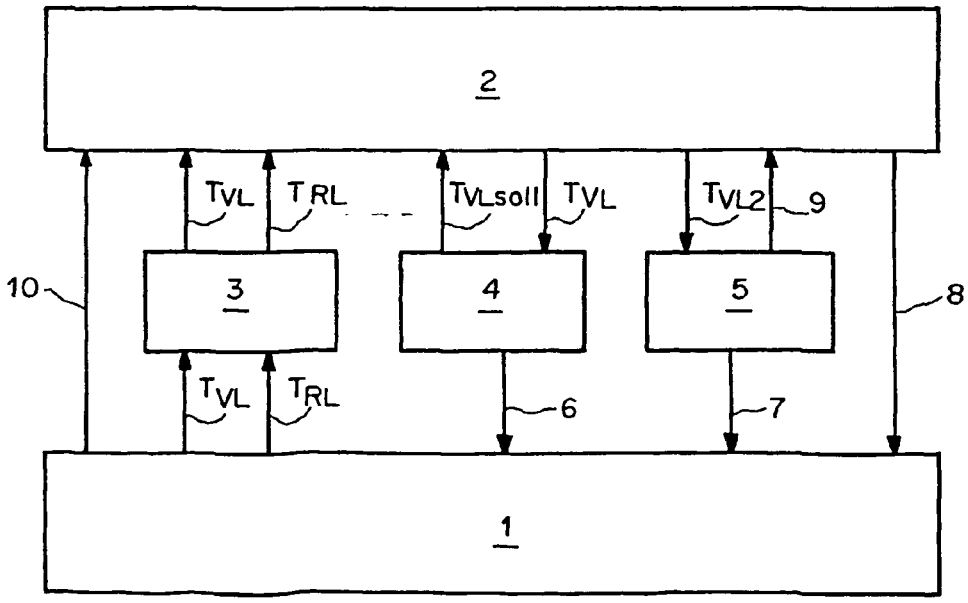

FIG. 2: the schematic representation of the method according to the invention and/or the device according to the invention.

FIG. 1 shows schematically the view of a heating system with heater 14 which has a boiler 16 and a burner 15, which is supplied with fuel via a fuel pipe 17. The heated heating water is pumped via a pump (not shown) into a flow pipe 11 to a heat exchanger 13 and returned from there via a return pipe 12 to the heater 14, where it is heated up again. After departure from the boiler 16, the flow temperature $T_{VL}$ of the heating water is measured whilst the return temperature $T_{RL}$ of the water is likewise measured shortly before the boiler 16 is reached.

FIG. 2 shows schematically the device according to the invention or the method according to the invention with automatic burner control 1 and temperature limiter 2 which receives a burner valve signal 10 from the automatic burner control 1. Furthermore the temperatures measured by the sensors not shown in FIG. 1, such as flow temperature $T_{VL}$ and return temperature $T_{RL}$, are conducted to the temperature limiter 2 for a plausibility check. Furthermore the device according to the invention or the method according to the invention includes a regulator 4 which sends a heat demand signal 6 to the automatic burner control 1. For example the regulator 4 is a 2.–/ modulation regulator. The regulator 4 sends a flow temperature reference value $T_{VLsoll}$ to the temperature limiter 2 which in turn checks the signals known to it for plausibility and sends a checked flow temperature signal $T_{VL2}$ to the regulator 4 and to the temperature monitor 5. The temperature monitor 5 uses this checked flow temperature signal $T_{VL2}$ to monitor the first predefinable maximum flow/boiler temperature $T_{VLmax1}$ and sends a monitor signal 7 to the automatic burner control 1 if the flow temperature $T_{VL}$ exceeds the first predefinable maximum flow/boiler temperature $T_{VLmax1}$. At the same time, the temperature monitor 5 sends a status signal 9 to the temperature limiter 2 which then, if the flow temperature $T_{VL}$ exceeds the second predefinable maximum flow/boiler temperature $T_{VLmax2}$, checks both this status signal 9 and the burner valve signal 10 and, if both signals are there, sends no switch-off signal 8 to switch off the lock the burner 15, because a normal temperature monitor switching-off of the burner 15 then occurs.

The temperature limiter 2 is advantageously an electronic temperature limiter which checks the flow temperature (or boiler temperature), a return temperature $T_{RL}$, a flow/boiler temperature reference value $T_{VLsoll}$, a status signal 9 of the temperature monitor 5 and optionally the burner valve signal 10 for plausibility using plausibility criteria, and provides the regulator 4 and/or the temperature monitor 5 with a checked flow/boiler temperature $T_{VL2}$.

The temperature limiter 2 sends the switch-off signal 8 to switch off and lock the burner 15 to the automatic burner control 1 if one or more of the plausibility criteria has not been fulfilled. After the burner 15 has been switched off, this is then locked against an automatic restart if the plausibility check delivered a corresponding result.

As a result of the method according to the invention or as a result of the device according to the invention, a safe and reliable operation of the burner 15 is achieved without it being unnecessarily switched off and locked. On the other hand, the burner 15 is however safely switched off and locked in the case of critical operating and danger states. The temperature limiter 2 thus monitors not only the individual temperature sensors 3 for short-circuit interruption or plausibility (for example an unnaturally high difference between flow and return temperature), but also the electronic temperature monitor 5. The monitoring of the individual sensors 3 ensures that the regulator 4 and the temperature monitor 5 are always supplied with reliable readings.

An advantageous test method for testing the method according to the invention and/or the device according to the invention for monitoring burners is carried out by successive switching-off of various functions of the temperature limiter 2 such that each individual function can be tested separately.

Each function of the temperature limiter 2 can thus be checked for plausibility using plausibility criteria by blocking or switching off the other functions separately and for example by introducing corresponding values of the flow/boiler temperature $T_{VL}$, the return temperature $T_{RL}$, the flow/boiler temperature reference value $T_{VLsoll}$, the status signal 9, the temperature monitor 5 and/or the burner valve signal 10.

By blocking all functions of the temperature limiter 2, i.e. if neither the temperature sensors 3 nor the regulator 4 nor the temperature monitor 5 is checked, the switch-off signal 8 to switch off and lock the burner 15 is then sent to the automatic burner control 1 if the predefinable second maximum flow/boiler temperature $T_{VLmax2}$ is reached or exceeded. Using a blocking of all functions of the temperature limiter 2, the switching limit, i.e. the exceeding of the predefinable second maximum flow/boiler temperature $T_{VLmax2}$ can thus be checked.

Thus the temperature limiter 2 can also be tested in respect of its functions if corresponding functions are provided which already switch off the burner 15 before the predefinable second maximum flow/boiler temperature is reached.

A bit pattern is advantageously defined for switching off and releasing of individual functions or function parts of the temperature limiter 2. By setting "0" and "1", individual functions can be activated or blocked. An example of such a bit pattern is represented in the following table:

| Bit no. | Function | Setting |
|---|---|---|
| 0 | TM switch-off | 0 or 1 |
| 1 | Temperature gradient exceeded | 0 or 1 |
| 2 | Delta-T ($\Delta v_{STB}$) too large | 0 or 1 |
| 3 | Delta-T ($\Delta v_{STB}$ + 8k) too large | 0 or 1 |
| 4 | Delta-T ($\Delta v_{STB}$ + 16k) too large | 0 or 1 |
| 5 | Return temperature > boiler/flow temperature | 0 or 1 |
| 6 | TM monitoring | 0 or 1 |
| 7 | free | 0 or 1 |

The switching-off of the burner 15 if the predefinable second maximum flow/boiler temperature $T_{VLmax2}$ is reached cannot be blocked using the table given above and is thus always active. If thus all functions of the table given above are blocked, the burner 15 is locked if the predefinable second maximum flow/boiler temperature is exceeded.

With the present invention, a dynamic monitoring of the behaviour of boilers 16 or thermal sources in connection with the various sensors 3 is thus possible so that the operation of the burner 15 can be subjected to better anticipatory control and optionally also switched off earlier.

The invention claimed is:

1. Method for monitoring burners with an automatic burner control for controlling and/or regulating the burner, optionally a regulator for regulating the automatic burner control and a temperature monitor, at least the flow/boiler temperature being detected and compared by means of the temperature monitor with a predefinable first maximum flow/boiler temperature, and the burner being switched off if the flow/boiler temperature reaches or exceeds the predefinable first maximum flow/boiler temperature, characterized in that the flow/boiler temperature is compared with a predefinable second maximum flow/boiler temperature, the predefinable second maximum flow/boiler temperature is higher than the predefinable first maximum flow/boiler temperature, and the burner is switched off and locked if the flow/boiler temperature reaches or exceeds the predefinable second maximum flow/boiler temperature and also an error signal of the temperature monitor was produced, wherein the error signal of the temperature monitor is produced if the flow/boiler temperature reaches or exceeds the predefinable first maximum flow/boiler temperature and a status signal of the temperature monitor signals no switching-off of the burner.

2. Method according to claim 1, characterized in that the error signal of the temperature monitor is produced if the flow/boiler temperature reaches or exceeds the predefinable first maximum flow/boiler temperature and a burner valve signal signals an open burner valve or there is no burner valve signal.

3. Method according to claim 1, characterized in that the error signal of the temperature monitor is produced if the flow/boiler temperature reaches or exceeds the predefinable second maximum flow/boiler temperature more than a predefinable number of times without a locking of the burner having taken place.

4. Method according to claim 3, characterized in that the error signal of the temperature monitor is not produced if the flow/boiler temperature does not reach or exceed the predefinable second maximum flow/boiler temperature the predefinable number of times within a predefinable period of time, without a locking of the burner having taken place.

5. Method according to claim 1, characterized in that the burner is switched off and locked if the flow/boiler temperature reaches or exceeds the predefinable second maximum flow/boiler temperature and the error signal of the temperature monitor was blocked or is not present.

6. Device for monitoring burners with an automatic burner control for controlling and/or regulating the burner, optionally a regulator for regulating the automatic burner control, at least one sensor for detecting a flow/boiler temperature and a temperature monitor which compares the flow/boiler temperature with a predefinable first maximum flow/boiler temperature and which switches off the burner if the flow/boiler temperature reaches or exceeds the predefinable first maximum flow/boiler temperature, characterized in that a temperature limiter compares the flow/boiler temperature with a predefinable second maximum flow/boiler temperature, the predefinable second maximum flow/boiler temperature being higher than the predefinable first maximum flow/boiler temperature and the temperature limiter sends a switch-off signal (8) to switch off and lock the burner to the automatic burner control if the flow/boiler temperature reaches or exceeds the predefinable second maximum flow/boiler temperature and the temperature limiter also receives an error signal and wherein the temperature limiter receives an error signal if the flow/boiler temperature reaches or exceeds the predefinable first maximum flow/boiler temperature and the temperature monitor sends a status signal to the temperature limiter which signals no switching-off of the burner.

7. Device according to claim 6, characterized in that the temperature limiter receives an error signal if the flow/boiler temperature reaches or exceeds the predefinable first maximum flow/boiler temperature and the temperature limiter detects an open burner valve by means of a burner valve signal.

8. Device according to claim 7, characterized in that the temperature limiter generates an error signal if there is no burner valve signal or no status signal of the temperature monitor.

9. Device according to claim 6, characterized in that the temperature limiter has a counter which counts the number of times the predefinable second maximum flow/boiler temperature is reached or exceeded without a locking of the burner having taken place.

10. Device according to claim 9, characterized in that the temperature limiter receives or generates no error signal if the counter does not reach or exceed a predefinable number within a predefinable period of time.

11. Device according to claim 6, characterized in that the temperature limiter is an electronic temperature limiter which checks the flow/boiler temperature, a return temperature, a flow/boiler temperature reference value a status signal (9) of the temperature monitor and optionally the burner valve signal for plausibility using plausibility criteria, and provides the regulator and/or the temperature monitor with a checked flow/boiler temperature.

12. Device according to claim 11, characterized in that the temperature limiter sends the switch-off signal to switch off and lock the burner to the automatic burner control if one or more of the plausibility criteria has not been fulfilled.

13. A method for monitoring burners having an automatic burner control for controlling and/or regulating the burner and a temperature monitor, a) detecting a flow/boiler temperature b) using the temperature monitor to compare the flow/boiler temperature with a predefinable first maximum flow/boiler temperature, c) providing control signals to switch off the burner if the flow/boiler temperature reaches or exceeds the predefinable first maximum flow/boiler temperature, d) providing control signals to switch off and lock the burner if both the flow/boiler temperature reaches or exceeds a predefinable second maximum flow/boiler temperature and an error signal of the temperature monitor is produced, the error signal of the temperature monitor being produced upon detection of an operational irregularity other than the flow/boiler temperature reaching or exceeding the predefinable second maximum flow/boiler temperature.

14. The method as claimed in claim 13, wherein the operational irregularity is at least one selected from a group consisting of: a status signal of the temperature monitor indicates no switching-off of the burner, an absence of a normally-present status signal of the temperature monitor, a burner valve signal indicates an open burner valve, and an absence of a normally-present burner valve signal.

15. The method as claimed in claim 13, wherein the operational irregularity is at least one selected from a group consisting of: a status signal of the temperature monitor indicating no switching-off of the burner, and an absence of a normally-present status signal of the temperature monitor.

16. The method as claimed in claim 13, wherein the operational irregularity is at least one selected from a set consisting of: a burner valve signal indicates an open burner valve, and an absence of a normally-present burner valve signal.

17. The method as claimed in claim 13, wherein the operational irregularity comprises the flow/boiler temperature reaching or exceeding the predefinable second maximum flow/boiler temperature more than a predetermined number of prior times within a clocking of the burner having taken place.

* * * * *